US005885145A

United States Patent [19]

O'Mara

[11] Patent Number: 5,885,145

[45] Date of Patent: Mar. 23, 1999

[54] POWERED DRYWALL SANDER AND PAINTER

[76] Inventor: John E. O'Mara, 1032 W. 70th St. North, Conway Springs, Kans. 67031

[21] Appl. No.: 847,128

[22] Filed: May 1, 1997

[51] Int. Cl.[6] ..... A46B 13/00; F16C 11/06; B24B 23/04

[52] U.S. Cl. ..... 451/356; 15/22.2; 403/56; 451/357; 451/354

[58] Field of Search ..... 451/351, 356, 451/357, 354; 15/22.1, 22.2, 98, 143.1; 403/56, 57, 74, 76, 113–116

[56] References Cited

U.S. PATENT DOCUMENTS

| | | | |
|---|---|---|---|
| 2,032,382 | 3/1936 | Torrison | 451/357 |
| 2,751,725 | 6/1956 | Champayne | 451/357 |
| 4,660,329 | 4/1987 | Hutchins | 451/357 |
| 4,671,020 | 6/1987 | Hutchins | 451/357 |
| 4,685,252 | 8/1987 | Ponce . | |
| 4,729,194 | 3/1988 | Maier et al. | 451/357 |
| 4,829,719 | 5/1989 | Braselton . | |
| 4,848,037 | 7/1989 | Happe . | |
| 5,022,190 | 6/1991 | Hutchins | 451/357 |
| 5,144,774 | 9/1992 | Conboy . | |
| 5,261,190 | 11/1993 | Berger et al. | 451/357 |
| 5,398,454 | 3/1995 | Berner | 451/357 |
| 5,655,250 | 8/1997 | Warrell | 15/228 |
| 5,690,545 | 11/1997 | Clowers et al. | 451/359 |

*Primary Examiner*—Timothy V. Eley
*Attorney, Agent, or Firm*—James E. Bradley

[57] ABSTRACT

A powered drywall sander and painter has a proximally located variable speed motor and a motor housing connected to a hollow lower handle. An upper handle telescopes into the interior of the lower handle. The motor rotates a drive shaft within the handles. The upper handle is fastened to an anti-rotation spring with an adjustable sleeve clamp. The upper end of the spring is clamped to a bottom slide to prevent rotational movement therebetween. A top slide having a sanding pad slidably engages the bottom slide. The rotation of the drive shaft is converted to lateral motion of the sanding pad at a distal end of the drive shaft. The sanding pad is free to swivel. The sanding attachment may be interchangeably replaced with a painting attachment. The painting attachment has a paint brush pad with bristles and a paint cup with a centrally located aperture which delivers paint to the paint cup. The painting attachment converts the rotational motion of the drive shaft into rotational motion of the paint brush pad. The painting attachment may be configured to swivel or may be fixed from swiveling motion with a bracket.

11 Claims, 8 Drawing Sheets

POWERED DRYWALL SANDER AND PAINTER

TECHNICAL FIELD

This invention relates in general to power tools and in particular to a motorized drywall sander and painter.

BACKGROUND ART

Conventional power drywall sanding or painting devices utilize motors which are typically located on distal ends of the devices. Use of these devices is tiring for the user because of the significant weight of the motor at the working end of the tool. This is particularly true of devices having extension handles. Moreover, two devices are required to perform sanding and painting operations. It is important that the working head be moveable, but that it be constrained against rotation. The device must also be capable of being locked in a predetermined position. It is desirable that a painter and/or sander be relatively light in weight because much of the work is done above the head of the user and excess weight results in fatigue to the user.

DISCLOSURE OF INVENTION

A powered drywall sander and painter has a proximally located variable speed motor and a motor housing connected to a hollow lower handle. An upper handle telescopes into the interior of the lower handle. The motor rotates a drive shaft within the handles. Together, the handles form a drive shaft housing. The upper handle is fastened to an anti-rotation spring with an adjustable sleeve clamp. The upper end of the spring is clamped to a bottom slide to prevent rotational movement therebetween. A top slide having a sanding pad slidably engages the bottom slide. The rotation of the drive shaft is converted to lateral motion of the sanding pad at a distal end of the drive shaft. The sanding pad is free to swivel.

The sanding attachment may be interchangeably replaced with a painting attachment. The painting attachment has a paint brush pad with bristles and a paint cup with a centrally located aperture which delivers paint to the paint cup. The painting attachment converts the rotational motion of the drive shaft into rotational motion of the paint brush pad. The painting attachment may be configured to swivel or may be fixed from swiveling motion with a bracket.

BEST MODE FOR CARRYING OUT THE INVENTION

Figure 1:
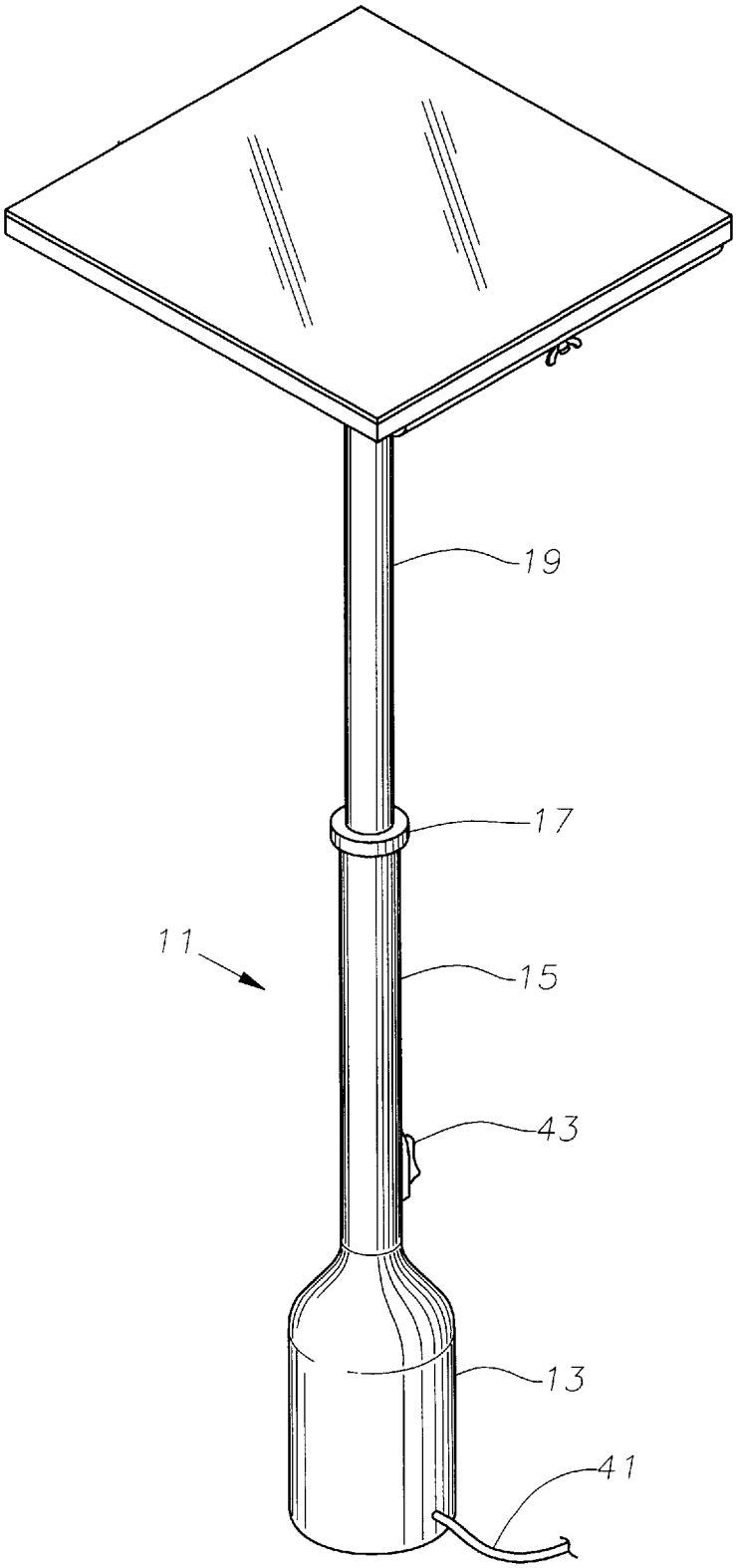
FIG. 1 is a perspective view of a power drywall sander and painter apparatus constructed accordance with the invention.
Figure 2:
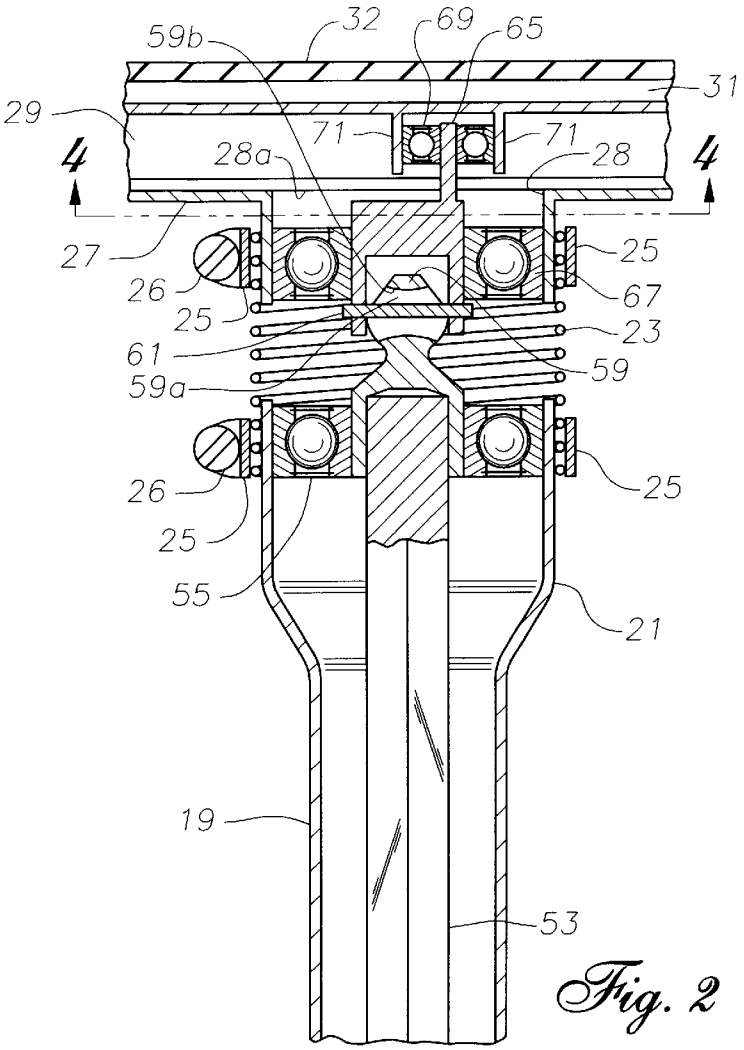
FIG. 2 is an elevational view in partial cross-section of the neck portion and sander attachment of the apparatus of FIG. 1.
Figure 5:
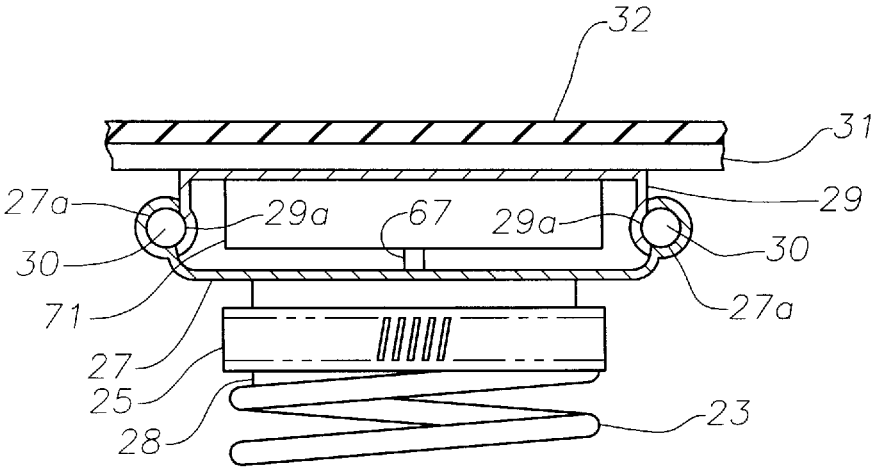
FIG. 5 is a cross-sectional view of the head portion of the apparatus of FIG. 1 taken along the line 5—5 of FIG. 4.

Referring to FIGS. 1, 2 and 5, numeral 11 illustrates a powered drywall sander and painter apparatus of the present invention. Powered drywall sander and painter 11 consists of a proximally located motor housing 13 connected to a hollow lower handle 15. Lower handle 15 terminates at a rotatably adjustable tightening collet 17 which forms a coupling between lower handle 15 and hollow upper handle 19. Upper handle 19 telescopes into the interior of lower handle 15 and is held in place with respect to lower handle 15 by tightening collet 17, thereby providing a means for adjusting the reach of the powered drywall sander and painter 11. Motor housing 13, lower handle 15, and upper housing 19 are preferably made of composite material (fiberglass-graphite) or plastic.

Upper handle 19 terminates at neck portion 21. Neck portion 21 is fastened to anti-rotation sleeve 23. In the preferred embodiment, anti-rotation sleeve 23 is a metallic coil spring. Alternatively, an elastomeric sleeve (not shown) could be employed in place of the spring. One end of anti-rotation sleeve 23 is wrapped around the exterior perimeter of neck portion 21 and held in place by adjustable sleeve clamp 25. Sleeve clamp 25 is tightened by sleeve clamp adjustment screw 26, providing sufficient compression between sleeve clamp 25, anti-rotation sleeve 23, and neck portion 21 to preclude any relative movement between the three. Sleeve clamp 25 is preferably a conventional hose clamp.

Bottom slide 27 is a square plate, the lengthwise edges of which are upturned in a hook fashion to form facing concave bearing channels 27*a*. Annular bottom slide ring 28 extends perpendicularly out from bottom slide 27 and is connected to bottom slide 27 around the periphery of annular bottom slide aperture 28*a* located at the center of bottom slide 27. The end of anti-rotation sleeve 23, opposite the end clamped to the neck portion 21, is wrapped around the exterior perimeter of bottom slide ring 28 and held in place by adjustable sleeve clamp 25. Sleeve clamp 25 is tightened by sleeve clamp adjustment screw 26, providing sufficient compression between sleeve clamp 25, anti-rotation sleeve 23, and bottom slide ring 28 to preclude any relative movement between the three. Top slide 29 is a square plate, the lengthwise edges of which are downturned in a hook fashion to form opposing convex bearing channels 29*a*. Slider ball bearings 30 are located in the channels formed by concave bearing channels 27*a* and convex bearing channels 29*a*, thereby connecting bottom slide 27 and top slide 29 and allowing relative lengthwise translational movement between bottom slide 27 and top slide 29. Bottom slide 27 and top slide 29 are preferably made of aluminum.

The upper surface of top slide 29 is connected to the lower surface of square sander pad 31. Sander pad 31 is longer than top slide 29 and overhangs both ends of top slide 29 for a distance sufficient to allow sand paper clamps 33 to be mounted to the lower surface and at each end of sander pad 31. Sander pad 31 is preferably made of aluminum. The upper surface of sander pad 31 is permanently attached to the lower surface of square sand paper cushion 32. Sand paper cushion 32 is preferably made of foam rubber to provide a cushion between the sander pad 31 and the sand paper (not shown).

Figure 6:
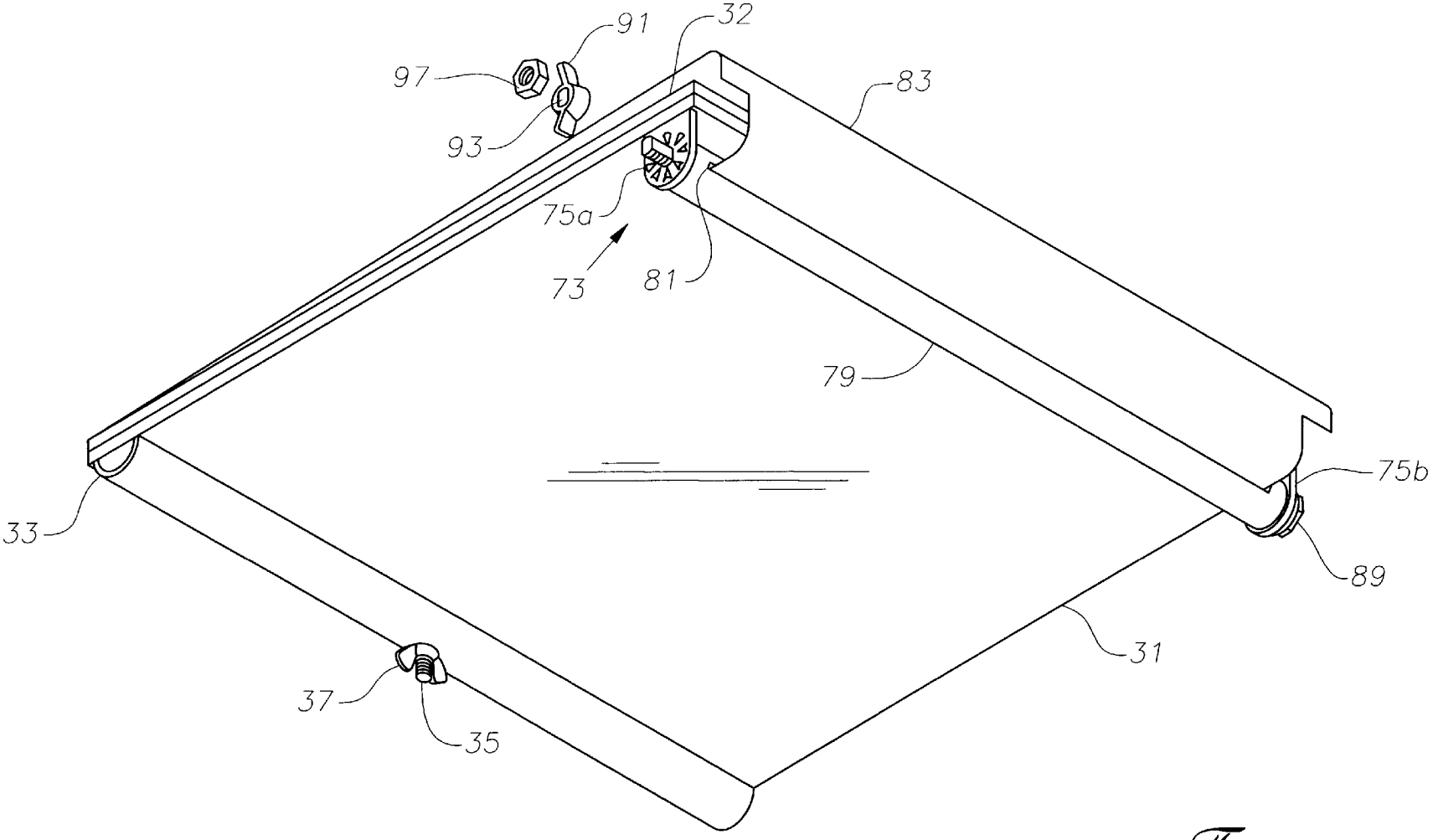
FIG. 6 is a respective view of the head portion of FIG. 4.

Referring to FIG. 6, semi-cylindrical sand paper clamps 33 are located on the lower surface and at each end of the sander pad 31 in the area of sander pad 31 which overhangs top slide 29. Each sand paper clamp 33 is received by a sand paper clamp adjustment screw 35 which extends perpendicularly out from the lower surface of sander pad 31 with a corresponding sand paper clamp adjustment wingnut 37. One end of a square sheet of sand paper (not shown) of approximately the same width as, but of greater length than the sander pad 31, is fed between the first sand paper clamp 33 and the lower surface of sander pad 31. The first sand paper clamp adjustment wingnut 37 is tightened about the first sand paper clamp adjustment screw 35 until sand paper is firmly sandwiched between the first sand paper clamp 33 and the sander pad 31. The sand paper is wrapped over the top of the cushion pad 32 and fed between the second sand paper clamp 33 and the lower surface of the sander pad 31 where it is held taut while the second sand paper clamp adjustment wingnut 37 is tightened about the second sand paper clamp adjustment screw 35 until the sand paper is firmly sandwiched between the second sand paper clamp 33 and the sander pad 31.

Figure 3:
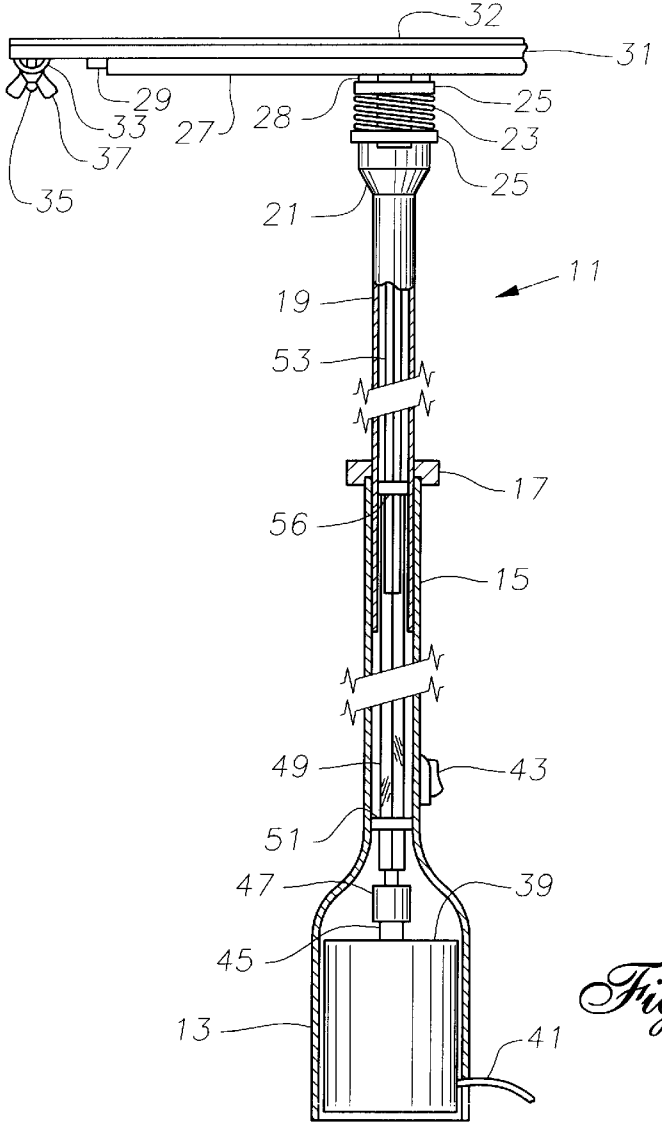
FIG. 3 is an elevational view, in partial cross-section, of the apparatus of FIG. 1.
Figure 4:
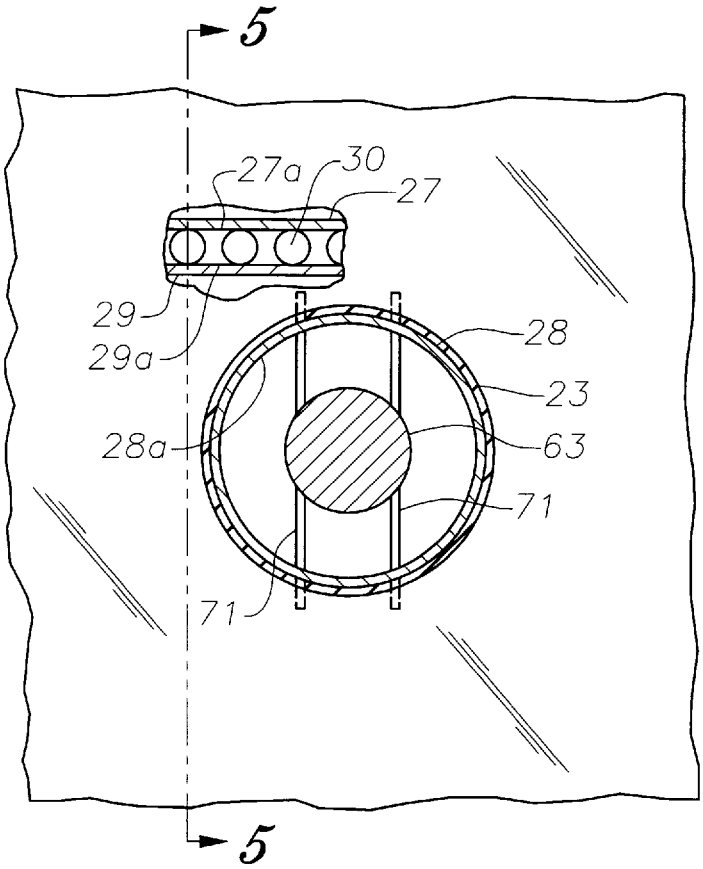
FIG. 4 is a cross-sectional view of the head portion of the apparatus of FIG. 1 taken along the line 4—4 of FIG. 2.

Referring also now to FIGS. 3 and 4, variable speed motor 39 is mounted inside motor housing 13. Variable speed motor 39 is preferably an electric motor with a power cord 41 which plugs into conventional power source (not shown). Variable speed switch 43 controls the operational speed of the motor shaft 45 of variable speed motor 39. Shaft coupler 47 attaches motor shaft 45 to hollow lower shaft 49, thereby transmitting rotational power from the variable speed motor 39 to the lower shaft 49. One or more lower shaft bearings 51 centrally locate the lower shaft 49 within lower handle 15 and allow it to longitudinally rotate freely. Upper shaft 53 telescopes into the interior of lower shaft 49. The cross-sectional geometry of lower shaft 49 and upper shaft 53 is such that as upper shaft 53 telescopes into lower shaft 49 rotational power is transmitted from lower shaft 49 to upper shaft 53. One or more upper shaft bearings 55 centrally locate the upper shaft 53 within the neck portion 21 and the upper handle 19 allowing the upper shaft 53 to longitudinally rotate freely. Coupler bearings 56 are attached to the telescoping end of lower shaft 49 to centrally locate upper shaft 53 within the upper handle 19, allow the upper shaft 53 to freely rotate within upper handle 19, guide upper handle 19 as it telescopes into lower handle 15, and guide upper shaft 53 as it telescopes into lower shaft 49.

Referring to FIG. 2, frustoconical transmission ball 57 is attached to the end of upper shaft 53 opposite the end of upper shaft 53 which telescopes into lower shaft 49. Ball 57 has a semi-spherical lower portion and a conical upper portion. Rotational power is transmitted from upper shaft 53 to transmission ball 57. Ball slot 59, defined by parallel side surfaces 59*a* and opposing convex base and top surfaces 59*b*, passes through the diameter of transmission ball 57. Transmission pin 61 passes through ball slot 59 of transmission ball 57 and thereby receives transmission of rotational power from transmission ball 57. Cylindrical wobble cam 63 consists of a concentric cylindrical bore 64 located on one face which receives transmission ball 57 and a cylindrical wobble cam pin 65 eccentrically located on the opposite face of wobble cam 63 extending outward parallel to the longitudinal axis of wobble cam 63. Both ends of transmission pin 61 extend beyond transmission ball 57 and are received by the walls of bore 64, thereby transmitting rotational power from transmission pin 61 to wobble cam 63. Wobble cam bearings 67 centrally locate wobble cam 63 within bottom slide ring 28 and allow wobble cam 63 to rotate freely. Wobble cam pin 65 extends through bottom slide aperture 28*a* and is received by pin bearings 69. Pin bearings 69 are received between bearing retainer walls 71 located on the lower surface of top slide 29, standing parallel to each other and extending parallel to the width of top slide 29. Bearing retainer walls 71 extend beyond the diameter of bottom slide ring 28 but do not extend to the downturned edges of top slide 29. As eccentric wobble cam pin 65 rotates, pin bearings 69 produce a force against the bearing retainer wall 71 which is in the direction of the lengthwise component of motion of the wobble cam pin 65 thereby transmitting the rotational power of the wobble cam 63 to the bearing retainer wall 71 and the top slide 29. The rotational power of the wobble cam 63 is thus converted to translational power of the top slide 29. Clearance between bearing retainer walls 71 and pin bearings 69 is such that as wobble cam pin 65 rotates and its lengthwise component of velocity changes direction, there is minimal impact and jerk on top slide 29.

Figure 7:
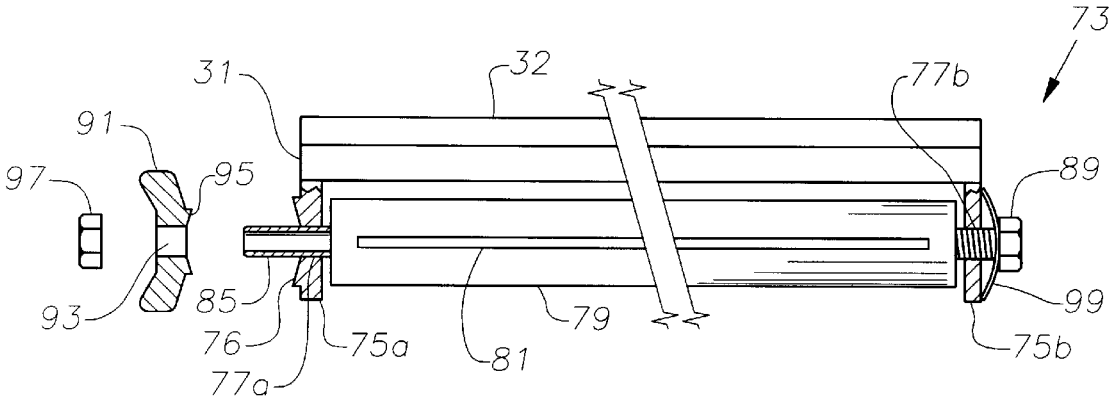
FIG. 7 i n elevational view in partial cross-section of the head portion of FIG. 6.

Referring now to FIGS. 6 and 7, an alternate embodiment of the sand paper clamp 33 is illustrated, wherein one of the sand paper clamps 33 is replaced with an anti-reverse ratchet clamp 73. Ratchet clamp 73 consists of a pair of ratchet clamp supports 75*a*, 75*b* which extend perpendicularly downward from the lower surface of sander pad 31. Ratchet clamp supports 75*a*, 75*b* include apertures 77*a*, 77*b*, respectively. Ratchet clamp support 75*a* includes ratchet teeth 76 on its exterior surface.

Sand paper roller 79 is a cylindrical shaft with a longitudinal slot 81 for receiving sand paper 83. Rectangular threaded crank pin 85 is attached to one end of sand paper roller 79 and extends through aperture 77*a* of ratchet clamp support 75*a*. Cylindrical threaded roller channel 87 extends longitudinally into the opposite end of sand paper roller 79 and receives threaded tension release screw 89. Roller wingnut 91 has a rectangular aperture 93 which receives rectangular crank pin 85. Wingnut teeth 95 are located on the interior surface of roller wingnut 91 to interlockingly engage ratchet teeth 76 of ratchet clamp support 75*a*. Threaded crank pin locknut 97 receives threaded crank pin 85. Concave spring washer 99 is located between tension release screw 89 and the exterior surface of ratchet clamp support 75*b* and allows wingnut teeth 95 to ratchet over ratchet teeth 76.

One end of sand paper 83 is clamped between sand paper clamp 33 and the other end of the sand paper 83 is fed into slot 81 of sand paper roller 79. Crank pin locknut 97 is tightened about crank pin 85 until wingnut teeth 95 of roller wingnut 91 are brought into engagement with ratchet teeth 76 of ratchet clamp support 75*a*. Sand paper 83 is wound about sand paper roller 79 by rotating roller wingnut 91 about the longitudinal axis of sand paper roller 79. The ratcheted engagement of wingnut teeth 95 and ratchet teeth 76 prevents unwinding of the sand paper 83 and maintains a desired tension in the sand paper 83. The ratcheted engagement of wingnut teeth 95 and ratchet teeth 76 is released by either loosening the crank pin locknut 97 or loosening the tension release screw 89.

Figure 8:
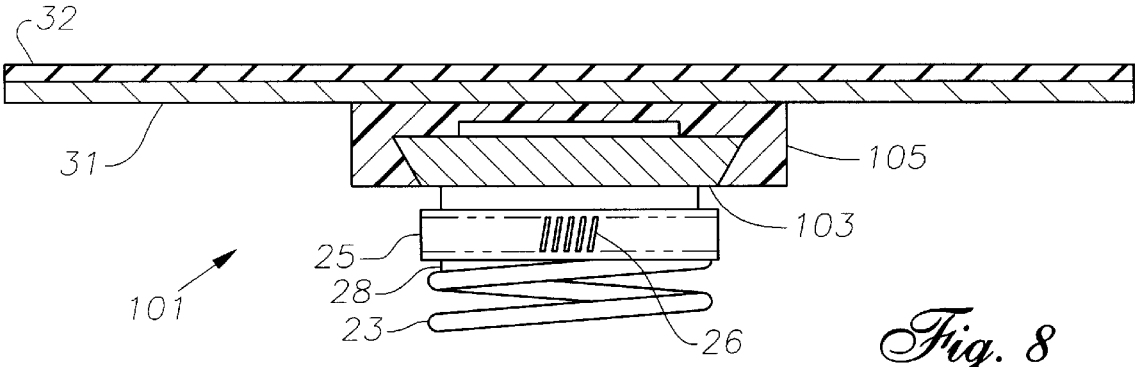
FIG. 8 is a cross-sectional view of an alternate embodiment of the head portion of FIG. 7.

Referring now to FIG. 8, numeral 101 illustrates an alternate slide assembly for the powered drywall sander and painter of the present invention consisting of bottom slide 103 of rhombic cross-sectional geometry which is interlockingly received by a top slide 105 of corresponding rhombic cross-sectional geometry. Bottom slide 103 and top slide 105 are preferably made of rigid nylon. Bottom slide ring 28 is attached to bottom slide 103 around the periphery of an aperture (not shown but similar to bottom slide aperture 28*a*)

in bottom slide 103. Bearing retainer walls (not shown but similar to bearing retainer walls 71) extend perpendicularly downward from the lower surface of top slide 105.

Figure 9:
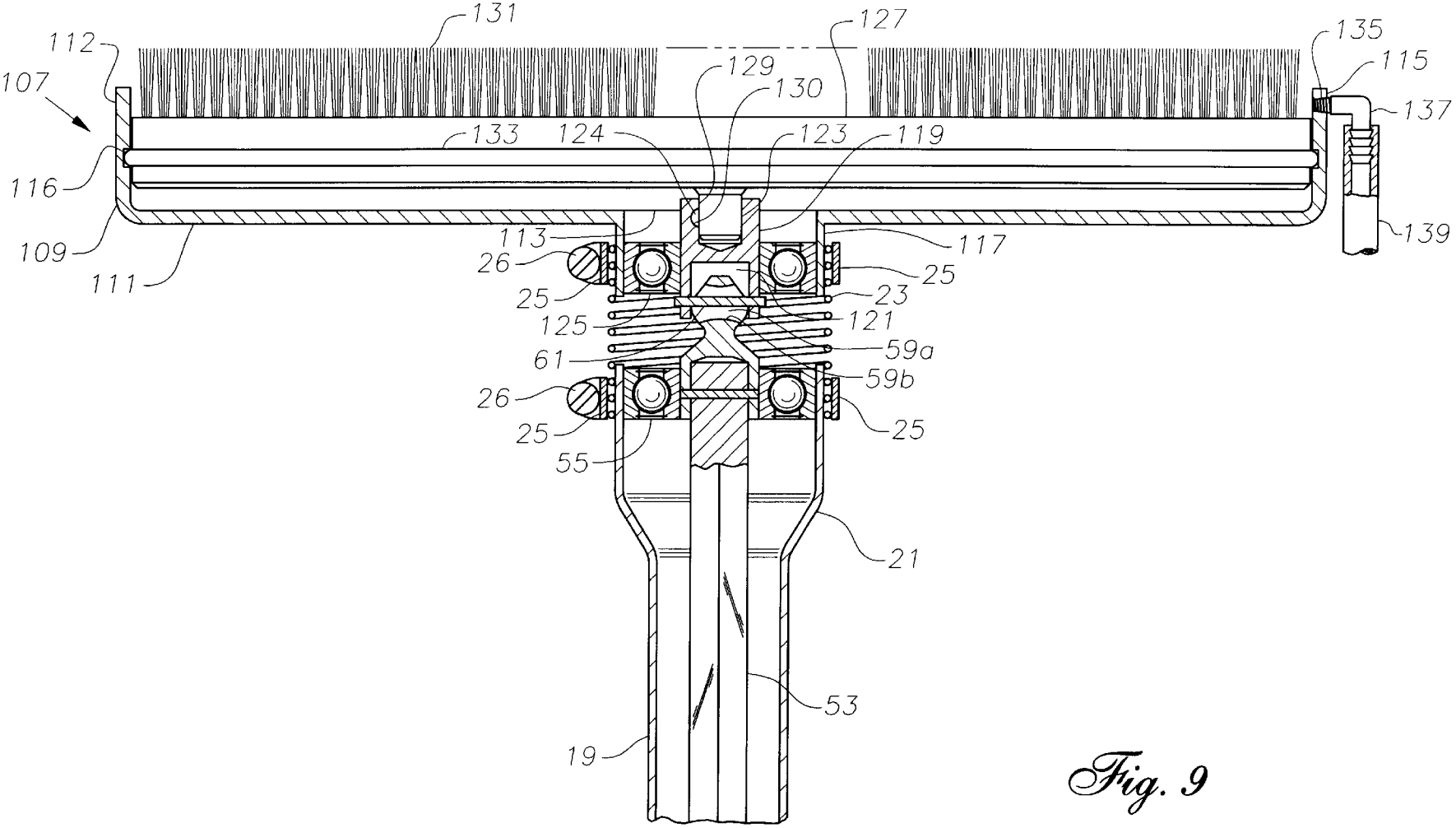
FIG. 9 is a cross-sectional view of a painting attachment for the apparatus of FIG. 1.

Referring now to FIG. 9, numeral 107 illustrates a painter attachment for the powered drywall sander and painter of the present invention. Painter attachment 107 is interchangeable with the sanding attachment on apparatus 11. Painter attachment 107 comprises a paint cup 109 having an annular paint cup base 111 with a centrally located aperture 113. Paint cup 109 has a cylindrical wall 115 extending perpendicularly upward from the paint cup base 111. Annular paint cup groove 116 encircles the interior surface of cylindrical wall 115 and extends into cylindrical wall 115 for a desired depth. Hollow cylindrical paint cup ring 117 is attached to the periphery of aperture 113 and extends perpendicularly downward from base 111. Anti-rotation sleeve 23 is secured as described above.

Cylindrical socket head 119 consists of a concentric cylindrical bore 121, located on one face which receives transmission ball 57, and a square socket bore 123 centrally located on the opposite face of socket head 119. Detent groove 124 surrounds the interior surfaces of square socket bore 123. Both ends of transmission pin 61 extend through the ball slot 59 and beyond transmission ball 57 and are received by the walls of bore 121, thereby transmitting rotational power from transmission pin 61 to socket head 119. Socket head bearings 125 centrally locate socket head 119 within paint cup ring 117 and allow socket head 119 to rotate freely. Paint brush pad 127 is a cylindrical disk with a centrally located square pin 129 attached to and extending perpendicularly downward from its lower surface. Paint brush pad 127 is covered by a plurality of bristles 131 attached to and extending perpendicularly upward from its upward face. Bristles 131 are preferably made of nylon and potted to paint brush pad 127 with epoxy. Square pin 129 is received by square socket 123, thereby transmitting rotational power from the socket head 119 to the paint brush pad 127. Detent ridge 130 is received by detent groove 124 of square bore 123 thereby maintaining connection between paint brush pad 127 and socket head 119. O-ring 133 encircles the perimeter of paint brush pad 127 and is received by annular groove (not shown) of paint brush pad 127 and paint cup groove 116 of cylindrical wall 115, thereby forming a positive seal between paint brush pad 127 and paint cup 109. O-ring 133 is preferably rubber. Supply aperture 135 in paint cup wall 115 receives one end of tubular supply hose connector 137. Supply hose connector 137 forms a coupling between paint cup 109 and pliable paint supply hose 139. Paint supply hose 139, preferably made of rubber, is a conduit for supplying paint from a pressurized paint source (not shown). A continuous flow of paint (not shown) from the pressurized paint source is forced through the supply hose 139, through the supply hose connector 137, and through the supply aperture 135, to the bristles 131 of the paint brush pad 127 as paint brush pad 127 is rotated by socket head 119. In this embodiment, brush pad 127 rotates about an axis that is in the same axial plane as an axis of drive shaft 53.

Figure 10:
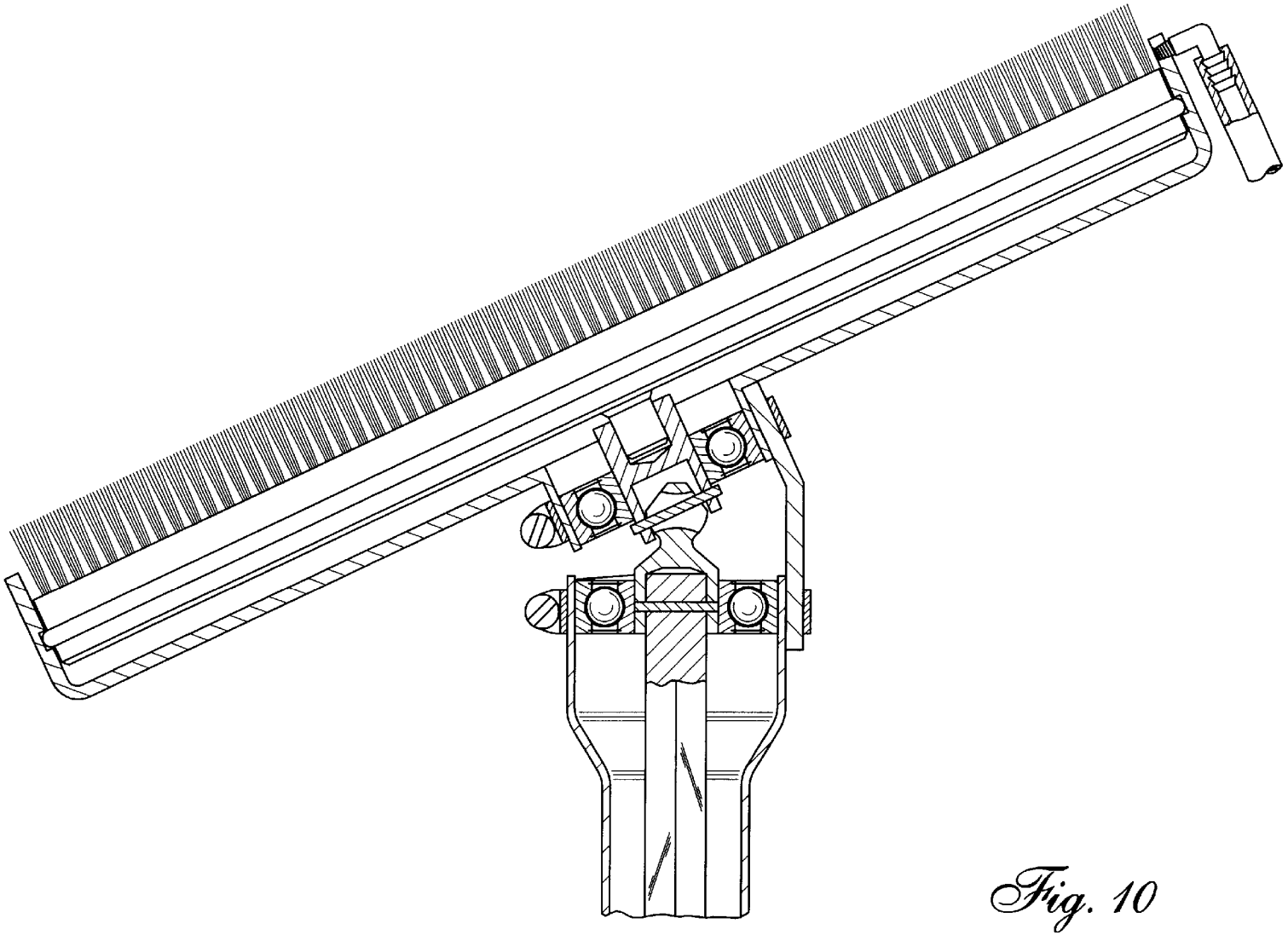
FIG. 10 is a first alternate embodiment of the painting attachment of FIG. 9.

As shown in FIG. 10, a rigid, semi-cylindrical bracket 141 having an obtuse-angled bend 143 is installed in place of sleeve 23. With bracket 141, painting attachment 107 may be fixed at an acute angle relative to a longitudinal axis of drive shaft 53. The interior portions of bracket 141 conform to the cylindrical exterior portions of drive shaft housing 19 and ring 117 when attachment 107 is positioned at the acute angle. Bracket is secured to housing 19 and ring 117 with clamps 25 in the same manner as sleeve 23.

Figure 11:
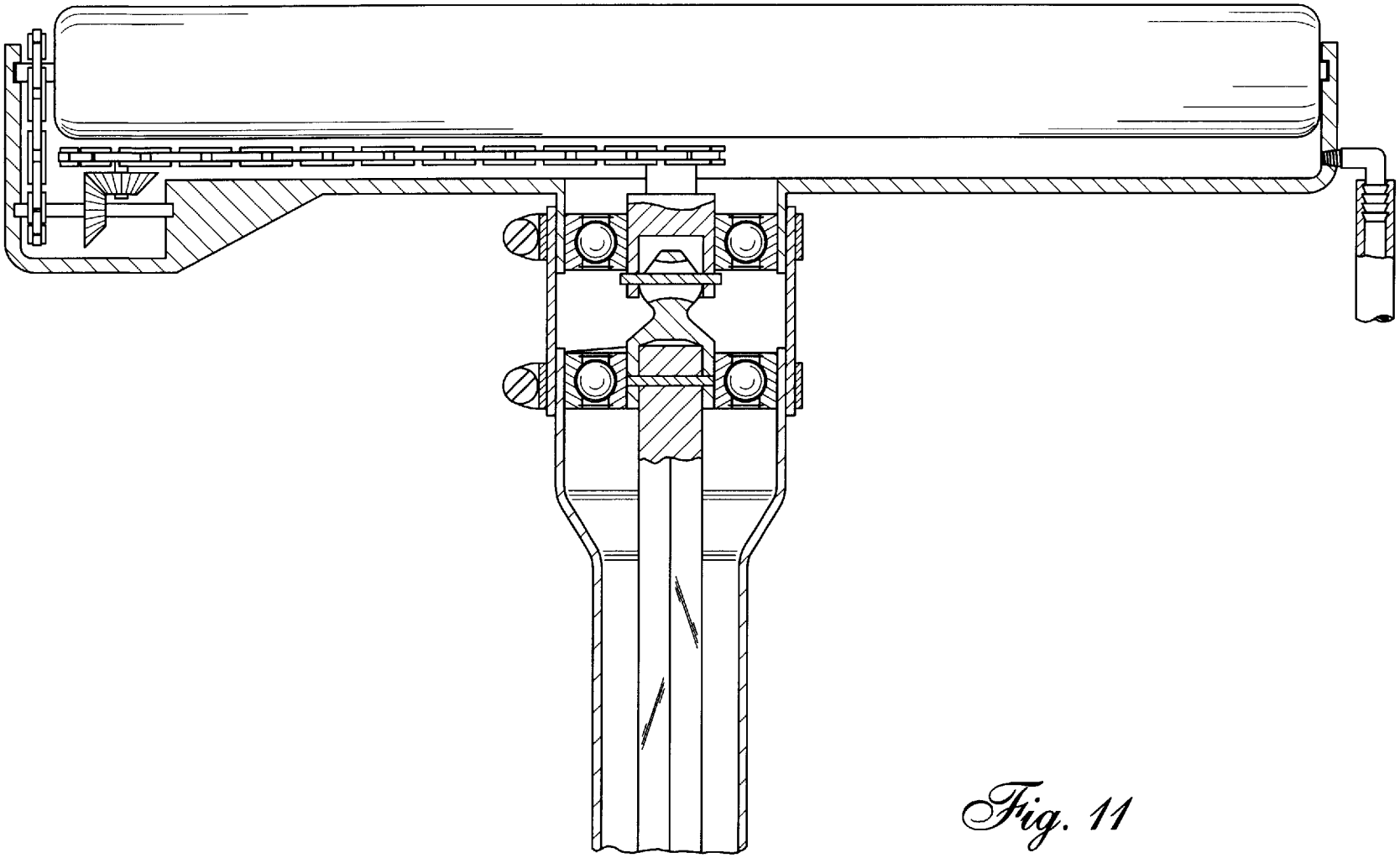
FIG. 11 is a second alternate embodiment of the painting attachment of FIG. 9.

Referring to FIG. 11, a second painter attachment embodiment is shown. Roller attachment 151 comprises a roller 153 instead of a brush and is interchangeable with painter attachment 107 and the sanding attachment described above. Roller attachment 151 also comprises a paint cup 155 having an annular paint cup base 157 with a paint supply aperture 159 on one end. Hollow cylindrical paint cup ring 161 is attached to the periphery of upper handle 19 and extends perpendicularly downward from base 157. Roller attachment 151 converts the rotary motion of drive shaft 53 into rotary motion of roller 153 with a series of gears 163 and sprockets 165 which drive chains 167 therebetween. Since roller attachment 151 is directly connected to apparatus 11, it does not require anti-rotation sleeve 23.

The invention has several advantages. The apparatus has interchangeable sanding and painting attachments which allow the same apparatus may be used to both sand and paint drywall. This feature eliminates the need for separate sanding and painting devices. Since the motor is located at a proximal end of the apparatus, the working end of the apparatus is lighter than and causes less fatigue of the user than prior art devices.

It should be apparent from the foregoing that an invention having significant advantages has been provided. While the invention is shown in only three of its forms, it is not just limited but is susceptible to various changes and modifications without departing from the spirit thereof.

I claim:

1. An apparatus for performing finishing work on a work surface, comprising:

a motor;

a drive shaft driven by the motor on a proximal end and having a distal end;

a drive shaft housing having a distal end and a proximal end attached to the motor, the drive shaft housing surrounding the drive shaft;

an attachment base;

a driven tool movably carried by the attachment base and coupled to the distal end of the drive shaft for engaging the work surface to perform finish work; and an anti-torque connector located between the attachment base and the distal end of the drive shaft housing for preventing the attachment base from rotating with the drive shaft, the anti-torque connector extending circumferentially around the drive shaft.

2. An apparatus for performing finishing work on a work surface, comprising:

a motor;

a drive shaft driven by the motor on a proximal end and having a distal end;

a drive shaft housing having a proximal end attached to the motor and a distal end, the drive shaft housing surrounding the drive shaft;

an attachment base;

a driven tool movably carried by the attachment base and coupled to the distal end of the drive shaft for engaging the work surface to perform finish work; and an anti-torque connector located between the attachment base and the distal end of the drive shaft housing for preventing the attachment base from rotating with the drive shaft; and wherein the anti-torque connector comprises a metallic, helical spring surrounding the drive shaft, the spring having one end secured to the drive shaft housing and an opposite end secured to the attachment base.

3. The apparatus of claim 2 wherein the driven tool comprises:

a sanding pad; and means for converting rotary motion of the drive shaft into reciprocating motion of the sanding pad.

4. An apparatus for performing finishing work on a work surface, comprising:

a motor;

a drive shaft driven by the motor on a proximal end and having a distal end;

a drive shaft housing having a proximal end attached to the motor and a distal end, the drive shaft housing surrounding the drive shaft;

an attachment base;

a driven tool movably carried by the attachment base and coupled to the distal end of the drive shaft for engaging the work surface to perform finish work; and an anti-torque connector located between the attachment base and the distal end of the drive shaft housing for preventing the attachment base from rotating with the drive shaft; and wherein the driven tool is coupled to the drive shaft by a swivel having a ball and a socket.

5. The apparatus of claim 4, further comprising an output-driven pin which is parallel to and offset from a longitudinal axis of the drive shaft.

6. An apparatus for performing finishing work on a work surface, comprising:

a motor;

a drive shaft driven by the motor on a proximal end and having a distal end;

a drive shaft housing surrounding the drive shaft, the drive shaft housing having a proximal end attached to the motor and a distal end;

an attachment base;

a sanding pad movably carried by the attachment base and coupled to the distal end of the drive shaft for engaging the work surface to perform finish work;

a pin coupled to the distal end of the drive shaft which is parallel to and offset from a longitudinal axis of the drive shaft and which engages the attachment base for converting rotary motion of the drive shaft into reciprocating motion of the sanding pad; and an anti-torque connector located between the attachment base and the distal end of the drive shaft housing for preventing the attachment base from rotating with the drive shaft, the anti-torque connector extending circumferentially around the drive shaft.

7. The apparatus of claim 6 wherein the anti-torque connector comprises a metallic, helical spring surrounding the drive shaft, the spring having one end secured to the drive shaft housing and an opposite end secured to the attachment base.

8. The apparatus of claim 6, further comprising an anti-reverse ratchet clamp for securing sand paper to the sanding pad.

9. The apparatus of claim 6, further comprising a slide assembly which interfaces between the pin and the sanding pad.

10. The apparatus of claim 6 wherein the attachment base and sanding pad are coupled to the drive shaft by a swivel having a ball and a socket.

11. The apparatus of claim 10 where in the ball has a conical upper portion.

* * * * *